US006050482A

United States Patent [19]

Cai

[11] Patent Number: 6,050,482

[45] Date of Patent: Apr. 18, 2000

[54] FOOD SCOOP

[75] Inventor: Liming Cai, West Chester, Pa.

[73] Assignee: Dopaco, Inc., Exton, Pa.

[21] Appl. No.: 09/126,853

[22] Filed: Jul. 31, 1998

[51] Int. Cl.[7] ..... B65D 5/00

[52] U.S. Cl. ..... 229/104; 229/117.05

[58] Field of Search ..... 229/104, 117.01, 229/117.05

[56] References Cited

U.S. PATENT DOCUMENTS

| | | | |
|---|---|---|---|
| 1,324,669 | 12/1919 | Harris | 229/104 |
| 2,002,493 | 5/1935 | Einson | 229/104 |
| 2,139,239 | 12/1938 | Mancuso | 229/104 |
| 2,139,534 | 12/1938 | Williamson | 229/104 |
| 2,232,088 | 2/1941 | Waters | 229/104 X |
| 2,291,753 | 8/1942 | Patten | 229/104 |
| 3,845,897 | 11/1974 | Buttery et al. | 229/104 X |
| 3,884,410 | 5/1975 | Giesecke | 229/104 |
| 4,267,955 | 5/1981 | Struble | 229/104 X |
| 5,720,428 | 2/1998 | Jensen | 229/104 |
| 5,862,980 | 1/1999 | Samuelson | 229/104 |

*Primary Examiner*—Stephen P. Garbe
*Assistant Examiner*—Tri M. Mai
*Attorney, Agent, or Firm*—Dennison, Scheiner, Schultz & Wakeman

[57] ABSTRACT

A fry scoop having front and rear walls and an upwardly and rearwardly inclined bottom formed of a narrow forward bottom panel and a wide rear bottom panel which provides for an upward shifting of the rear wall as compensation for a reduced height of the panel forming the rear wall.

9 Claims, 3 Drawing Sheets

FOOD SCOOP

BACKGROUND OF THE INVENTION

The invention is broadly concerned with paperboard containers, and more particularly with the type of container commonly referred to as a "fry scoop", principally used for french fries and other such foodstuffs.

Containers of this type, normally formed of foldable paperboard, are a single-use product principally used in fast food establishments, and as such are used in large quantities. Thus, it is particularly desirable that the costs associated therewith, in materials, manufacturing, storage, shipping, manner of use, and the like, be maintained at a minimum.

SUMMARY OF THE INVENTION

It is a primary object of the present invention to provide a food container which, while generally indistinguishable from the conventional fry scoop in both appearance and manner of use, provides for a substantial savings in material as compared to the conventional scoop. As suggested above, any savings in material on the individual scoops, when multiplied over the vast quantity of such scoops used daily, can provide substantial savings in cost.

In conjunction with the principal object of reducing the amount of material used, it is also particularly significant that, notwithstanding this savings in material, the erected carton presents a carton, which in forward appearance, height, width, and capacity is the same as that of a conventional scoop.

Other objects of the invention include the provision that the scoop of the invention utilizes the same manufacturing process as used in the formation of a conventional carton, requiring only a repositioning of a single fold line, and further that the improved scoop is erected for use, at the point of sale of the foodstuff, in the manner of a conventional carton, requiring no new manufacturing equipment or training.

The savings in material becomes readily apparent in both the blank and the folded carton prior to setup wherein, in each instance, the blank and folded carton are of a slightly shorter height. This, with regard to the folded or collapsed carton, is additionally significant in minimizing shipping and storage bulk, reducing both packing case size and space, and providing resultant cost savings.

Basically, the fry scoop, formed from an appropriate foldable sheet material, preferably paperboard, includes front and rear walls joined by opposed side flanges and a bottom which, upon upward folding, retains the front and rear walls in outwardly convex opposed configurations to define the container chamber or interior.

In the conventional carton, the bottom is equally divided into front and rear bottom panels by a central fold line whereby, in the formed carton, the bottom, while arcing transversely between the side edges of the open carton, is level or maintains a constant height rearwardly from the front wall to the rear wall.

In the present invention, the fold line defined in the bottom is offset from the center of the bottom toward the front wall. With the fold line so positioned, and with the forward bottom panel of a lesser depth than the rear bottom panel, upon an upward folding of the bottom between the sides, the bottom will upwardly slope from the front wall to the rear wall and, in effect, upwardly shift the rear wall. Inasmuch as the savings in material is a result of a reduction in the overall height of the rear wall in particular, this upward shifting of the rear wall in the erected carton brings the exposed portion of the rear wall, that portion seen above the recessed front wall, to a height equal to that of the height of the rear wall of a conventional scoop. As such, there is no difference in appearance between the scoop of the invention and the conventional scoop when viewed from the front and side thereof. The actual manner of opening the folded scoop for filling is no different than that associated with the conventional scoop.

Another advantage residing in the upwardly sloping bottom is, assuming the same amount of fries within the scoop, is the higher appearance of the fries, at least toward the rear wall of the scoop, thus providing a fuller and more attractive appearance, notwithstanding the conventional appearance of the scoop itself and the reduced material used in the formation thereof.

Other features and advantages of the invention will become more apparent from the more detailed description following hereinafter.

DESCRIPTION OF PREFERRED EMBODIMENT

Figure 1:
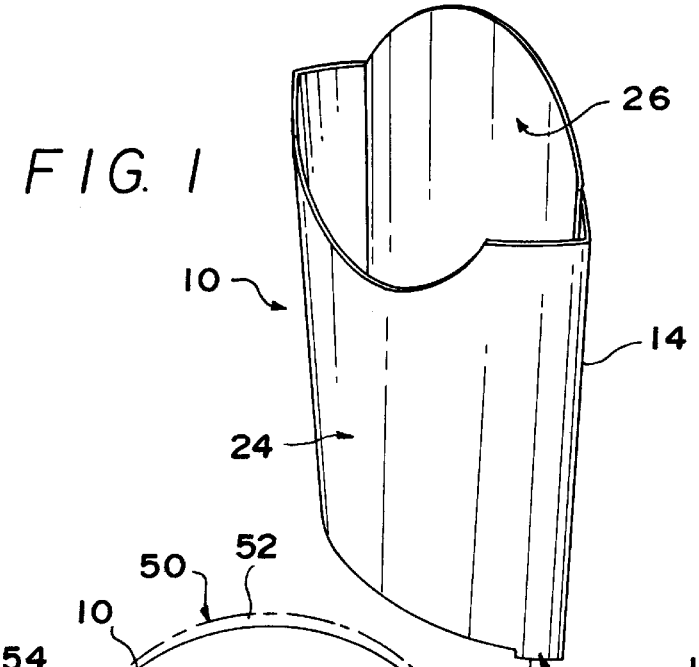
FIG. 1 is a front prespective view of the scoop of the invention opened to receive foodstuffs.
Figure 2:
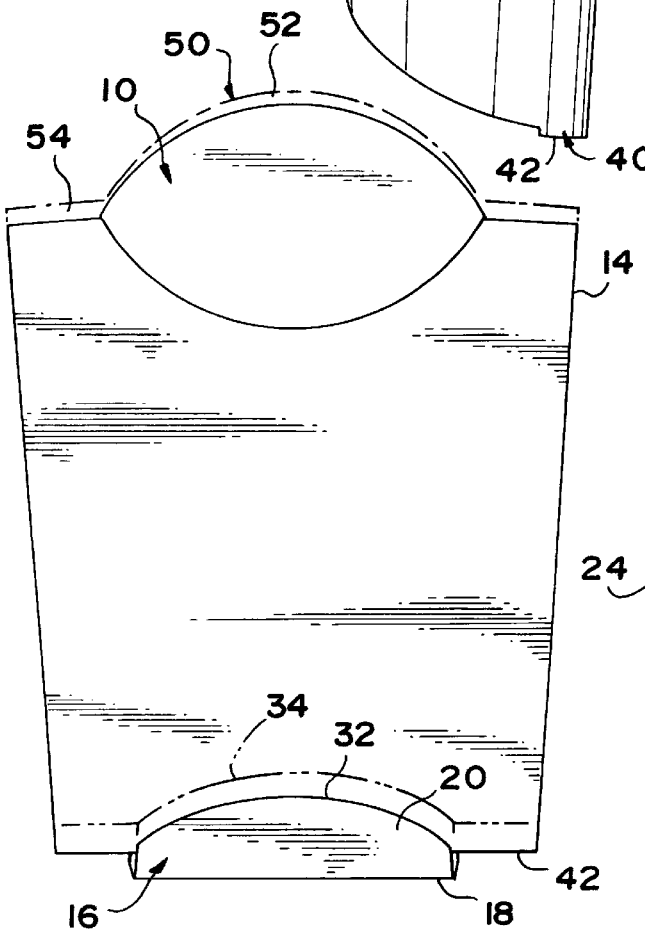
FIG. 2 is a front plan view of the scoop folded prior to use, with the greater height of the folded conventional carton illustrated in phantom lines.
Figure 4:
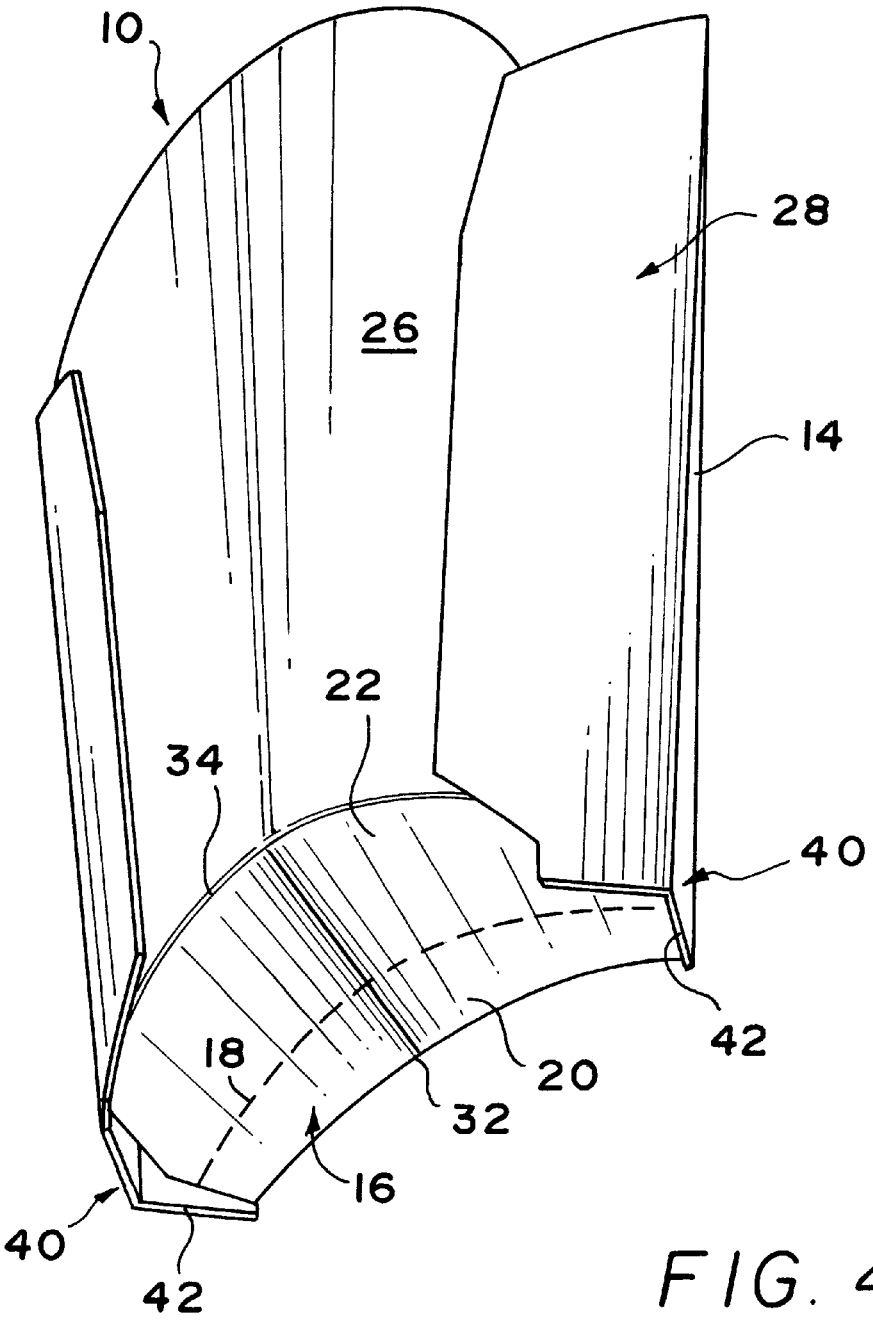
FIG. 4 is a bottom perspective view of the scoop further illustrating the folding bottom with offset fold line.

Referring now more specifically to the drawings, the carton or scoop 10 is folded from a blank 12 of paperboard or the like and is selectively expandable, at the time of use, from the collapsed position of FIG. 2 to the full expanded position of FIGS. 1 and 4.

The expansion of the carton prior to filling is effected by applying inward pressure on the opposed side edges 14 thereof and upward pressure on the bottom 16 generally along a full length bottom fold line 18 dividing the bottom 16 into a forward bottom panel 20 and a rear bottom panel 22. The front wall 24 and rear wall 26 of the carton 10, in the collapsed position of FIG. 2, are in parallel overlying relation with each other and, in the expanded or erected carton, are outwardly convex relative to each other with the opposed vertical side edges of the front and rear walls defining the side edges 14 of the carton.

Figure 5:
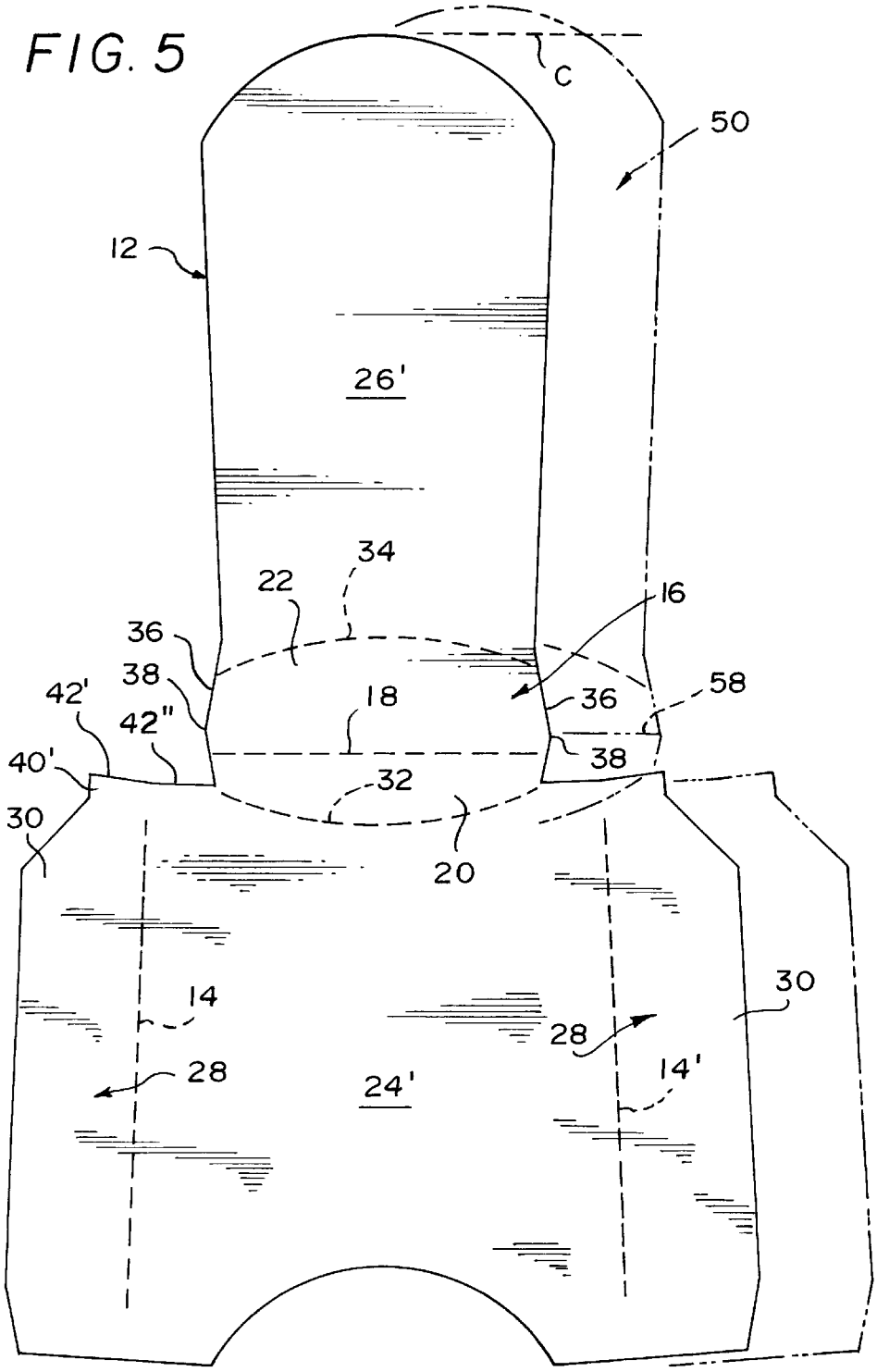
FIG. 5 is a plan view of the blank of the invention with a partial illustration, in phantom lines, of a conventional blank offset slightly therefrom and illustrating the reduction in length made possible by a repositioning of the bottom fold line.

Noting the blank of FIG. 5, it will be seen that the front wall 24 is formed by a front wall panel 24' having full height opposed side flanges 28 joined thereto along fold lines 14' which define the opposed side edges 14 of the folded container 10. Upon a folding of the blank 12, the side flanges 24, which include glue edges 30 thereon, are adhesively secured to the opposed edge portions of the rear wall panel 26', combining therewith to form the full width rear wall 26 of the container 10.

With continued reference to the blank of FIG. 5, it will be seen that the bottom 16, integrally positioned between the front and rear wall panels 24' and 26', is defined by a front fold line 32 and a rear fold line 34 each outwardly arcing toward the respective front and rear wall panels 24' and 26'. The opposed edges 36 of the bottom 16 each comprise two edge segments forming opposed apices 38 which define the transverse center of the bottom 16 between the opposed arcuate fold lines 32 and 34.

As will be appreciated, the open carton 10 rests on opposed foot-like portions or supports 40 at the opposed sides of the carton in alignment with the carton side edges 14 and the adjoining portions of the front and rear walls. These supports 40, noting the blank, are defined by slightly extending lower end portions 40' of the side flanges 28 and adjacent portions of the front wall panel 24' laterally outward of the bottom 16. The foot-like portions 40 have lower edges 42, below the bottom 16. These lower edges, in the blank, are defined by inwardly converging line segments 42' and 42", which in the erected and expanded carton, provide planar or horizontal support surfaces for maintaining the carton upright. The bottom 16, not directly secured to the carton sides, is upwardly offset from and arcs upward between the side supports 40.

Figure 3:
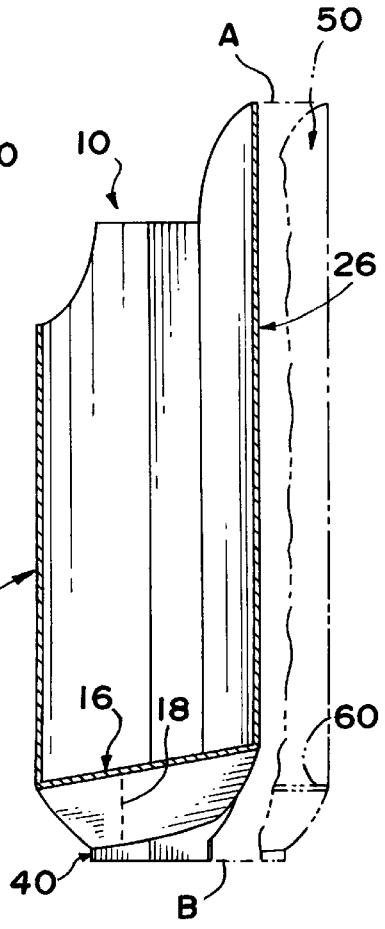
FIG. 3 is a front-to-rear cross-section illustrating the inclined bottom, this figure also illustrating, in phantom lines, a partial cross-sectional view of a conventional carton with flat bottom.

The above written description of the invention substantially equally describes a conventional fry scoop which, in FIGS. 2, 3 and 5, has been partially illustrated, as at 50, in phantom lines. Of particular significance, and as illustrated in FIG. 3 by parallel lines A and B, the erected carton 10 of the invention is of equal height with the conventional carton 50. The collapsed carton, as in FIG. 2, to the contrary and as indicated at 52 and 54, is, while of the same width as the conventional carton, of less height, approximately 3/16" shorter for a conventional size scoop. Similarly, the blank, and more specifically the rear wall panel 26' thereof, is, as indicated at line C, of a substantially lesser height, on the order of 3/8" for a conventional size scoop.

This capability of presenting an in-use appearance of a conventional scoop, while significantly reducing the material required, is uniquely achieved by the specific positioning of the bottom fold line 18. More particularly, in the conventional scoop construction, and noting FIG. 5, the bottom fold line 58 is positioned centrally between the opposed arcuate edges of the bottom 16 and extends between opposed side apices to form two equal sized bottom panels. Thus, and noting the conventional carton 50 as it appears in FIG. 3, the bottom 60 of the conventional scoop is of equal height or horizontal in a front to rear direction, while of course still retaining its arcuate lengthwise configuration across the side-to-side width of the carton.

However, in the structure of the invention, the bottom fold line 18 is positioned appreciably closer to the front wall panel 24', offset from the center of the bottom panel 16 defined by the opposed apices 38. Thus positioned, the fold line 18 defines a front bottom panel 20 of substantially less front to rear depth than that of the rear bottom panel 22. This difference in depth between the narrower front bottom panel and the broader rear bottom panel, in the erected carton as best seen in FIG. 3, results in a rearward and upward inclination of the bottom 16, across the transverse width of the carton, and a corresponding vertically upward shifting or elevation of the rear wall 26 to compensate for the reduction in height of the rear wall panel. This in turn gives the appearance of a full height rear wall in the erected carton, that is a rear wall which, above the support surface defined by the support edges 42 of the support feet 40, is of equal height as that of the rear wall of a conventional scoop.

The off center positioning of the fold line 18, compensating for the relatively shorter rear wall 26 by an upward shifting of the rear wall also enhances the appearance of the foodstuff within the scoop. More particularly, the upward and rearwardly inclined bottom tends to raise the level of the french fries or the like within the carton and particularly toward the rear of the carton along the rear wall, thus providing a fuller and more bountiful appearance that would be the case with an equal amount of foodstuff in the conventional scoop.

The foregoing is illustrative of the invention, and all variations as may occur to those skilled in the art, are to be considered within the scope of the claims following.

I claim:

1. A food carton comprising a bottom, front and rear walls having lower edges and extending upward from said bottom, and opposed sides, said front and rear walls being joined at said sides, said bottom being joined to and extending between said front and rear wall lower edges, said carton including support means for supporting said carton upright and defining a support plane below said bottom, said bottom being of a greater height above said support plane at said rear wall than at said front wall wherein said rear wall lower edge is upwardly offset relative to said front wall lower edge, said walls and said bottom are integral and defined from a unitary blank of foldable material, and including a first fold line between said bottom and said front wall, a second fold line between said bottom and said rear wall, and a third fold line in said bottom between said first and second fold lines and defining a forward bottom panel between said first and third fold lines, and a rear bottom panel between said second fold line and said third fold line, said forward bottom panel having a front to rear depth less than a front to rear depth of said rear bottom panel and wherein said first and second fold lines form opposed convex front and rear edges on said bottom, said bottom, between said sides, being upwardly arced.

2. The carton of claim 1 wherein said front and rear walls are outwardly convex relative to each other.

3. The carton of claim 2 wherein said carton is foldable to a collapsed position with said front and rear walls planar and in contacting overlying relation to each other, said third fold line, in said collapsed position of said carton, being linear.

4. The carton of claim 1 wherein said front and rear walls are outwardly convex relative to each other.

5. The carton of claim 4 including a first fold line between said bottom and said front wall, a second fold line between said bottom and said rear wall, and a third fold line in said bottom between said first and second fold lines and defining a forward bottom panel between said first and third fold lines, and a rear bottom panel between said second fold line and said third fold line, said forward bottom panel having a front to rear depth less than a front to rear depth of said rear bottom panel.

6. The carton of claim 5 wherein said carton is foldable to a collapsed position with said front and rear walls planar and in contacting overlying relation to each other, said third fold line, in said collapsed position of said carton, being linear.

7. Carton construction comprising front and rear walls with a bottom integral with and extending between said front and rear walls, a first fold line between said front wall and said bottom, a second fold line between said rear wall and said bottom, said fold lines being outwardly convex relative to each other, and a third fold line in said bottom intermediate said first and second fold lines and closer to said first fold line than to said second fold line wherein said bottom is divided into a front bottom panel adjacent said front wall, and a larger rear bottom panel adjacent said rear wall.

8. A foldable carton structure comprising an elongate planar blank of foldable sheet material having front and rear longitudinally aligned wall panels, a bottom panel between said front and rear wall panels and defined by opposed first and second fold lines respectively between said bottom panel and said front and rear wall panels, said first and second fold lines being outwardly convex relative to each other, and a third fold line in said bottom panel intermediate said first and second fold lines and closer to said first fold line than to said second fold line.

9. The carton structure of claim 8 wherein said third fold line is straight.

* * * * *